US007752820B2

(12) United States Patent
Deschamps

(10) Patent No.: US 7,752,820 B2
(45) **Date of Patent: *Jul. 13, 2010**

(54) FAST UNFOLDING TWO-LAYER TEMPORARY FLOORING STRUCTURE

(75) Inventor: Georges-Paul Deschamps, Angouleme (FR)

(73) Assignee: Ets A. Deschamps et Fils, La Couronne (FR)

( * ) Notice: Subject to any disclaimer, the term of this patent is extended or adjusted under 35 U.S.C. 154(b) by 1052 days.

This patent is subject to a terminal disclaimer.

(21) Appl. No.: 10/492,424

(22) PCT Filed: Oct. 10, 2002

(86) PCT No.: PCT/FR02/03452

§ 371 (c)(1),
(2), (4) Date: Apr. 12, 2004

(87) PCT Pub. No.: WO03/031724

PCT Pub. Date: Apr. 17, 2003

(65) Prior Publication Data

US 2005/0126095 A1 Jun. 16, 2005

(30) Foreign Application Priority Data

Oct. 12, 2001 (FR) ..... 01 13188

(51) Int. Cl.
*E04B 5/00* (2006.01)

(52) U.S. Cl. ..... 52/383; 52/83; 52/70; 52/71; 52/72; 52/108; 52/222; 52/273; 52/582.1; 52/394; 52/387; 52/535

(58) Field of Classification Search ..... 52/70, 52/71, 630, 31, 173, 65, 309.7, 342, 582.1, 52/799.1, 109, 108, 23, 63, 83, 222, 273, 52/173.1, 383, 387, 394, 535, 796.1; 181/30; 160/135, 229.1; 446/1, 109, 112–113, 487; 296/100.06; 428/130; 404/35
See application file for complete search history.

(56) References Cited

U.S. PATENT DOCUMENTS

| | | | | |
|---|---|---|---|---|
| 2,822,585 | A * | 2/1958 | Baruch | 52/582.1 |
| 3,294,272 | A * | 12/1966 | Nagler | 220/6 |
| 3,300,938 | A * | 1/1967 | Van Schyndel et al. | 52/581 |
| 3,466,830 | A * | 9/1969 | Smith | 52/777 |
| 3,616,111 | A * | 10/1971 | Raech, Jr. | 428/52 |
| 4,118,901 | A * | 10/1978 | Johnson | 52/18 |
| 4,850,738 | A * | 7/1989 | Niemi | 404/31 |
| 4,923,728 | A * | 5/1990 | Snedeker | 428/52 |
| 5,033,241 | A * | 7/1991 | Max | 52/71 |
| 5,132,156 | A * | 7/1992 | Trassare et al. | 428/116 |

(Continued)

FOREIGN PATENT DOCUMENTS

DE 4217569 A1 * 12/1993

*Primary Examiner*—Jeanette Chapman
(74) *Attorney, Agent, or Firm*—Young & Thompson

(57) ABSTRACT

A fast unfolding two-layer temporary flooring structure consisting of preferably rigid plates (1 to 6), made of a suitable material. The plates (1 to 6) are arranged mutually parallel and cascade-linked by an articulated linking element (B) so that between two consecutive plates, the element (B) is linked to an edge of the other plates, and also preferably in a central zone of the other plate, the elements defining hinge lines between parallel planes with longitudinal or transverse axis of the plates.

8 Claims, 4 Drawing Sheets

U.S. PATENT DOCUMENTS

| | | | | |
|---|---|---|---|---|
| 5,214,885 | A * | 6/1993 | Maas et al. | 52/71 |
| 6,058,660 | A * | 5/2000 | Melton | 52/71 |
| 6,233,881 | B1 * | 5/2001 | Rainbolt | 52/83 |
| 6,499,498 | B1 * | 12/2002 | Zheng | 135/125 |
| 6,511,257 | B1 * | 1/2003 | Seaux et al. | 404/34 |
| 6,685,388 | B2 * | 2/2004 | Webster et al. | 404/35 |
| 6,955,500 | B1 * | 10/2005 | Smith et al. | 405/20 |
| 6,968,652 | B1 * | 11/2005 | Eadie | 52/71 |
| 7,387,295 | B2 * | 6/2008 | Talbott | 256/13.1 |
| 2007/0062147 | A1 * | 3/2007 | Wright | 52/582.1 |

* cited by examiner

FAST UNFOLDING TWO-LAYER TEMPORARY FLOORING STRUCTURE

FIELD OF THE INVENTION

The present invention relates to a temporary dual-layer rapid-deployment ground-covering structure.

SUMMARY OF THE INVENTION

The aim of the invention is to propose a structure formed from panels, for example rectangular, formed of rigid individual plates made from plastic or composite material, able to be deployed easily and rapidly so as to form a temporary surface or track for storing products or for movement for vehicles.

To this end, the object of the invention is a temporary dual-layer rapid-deployment ground-covering structure formed from plates, preferably rigid, made from suitable material, characterised in that the said plates are disposed parallel to each other and are connected together in cascade by a connecting element articulated so that, between two consecutive plates, the said element is connected firstly to one edge of one of the plates and secondly and preferably in a central area of the other plate, the said element defining inter-plate articulation axes parallel to the longitudinal or transverse axis of the plates.

DETAILED DESCRIPTION OF THE PREFERRED EMBODIMENTS

The plates 1 to 6 are for example rectangular, identical and parallel to each other.

Figure 1:
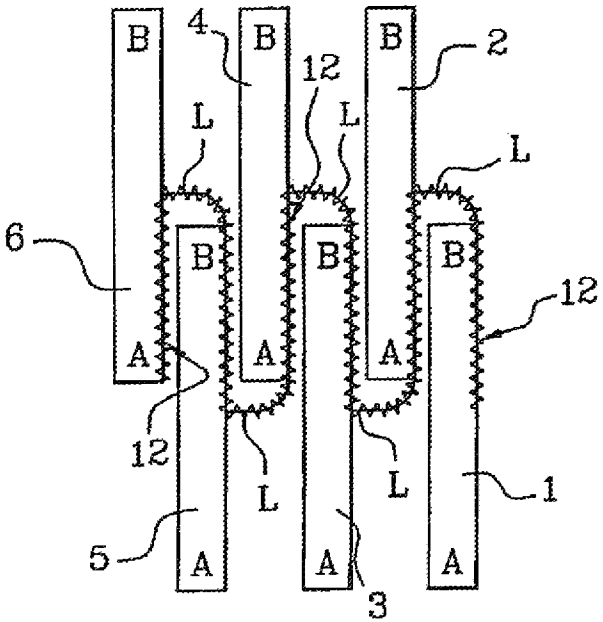
FIGS. 1 and 2 illustrate schematically a first embodiment.
Figure 2:
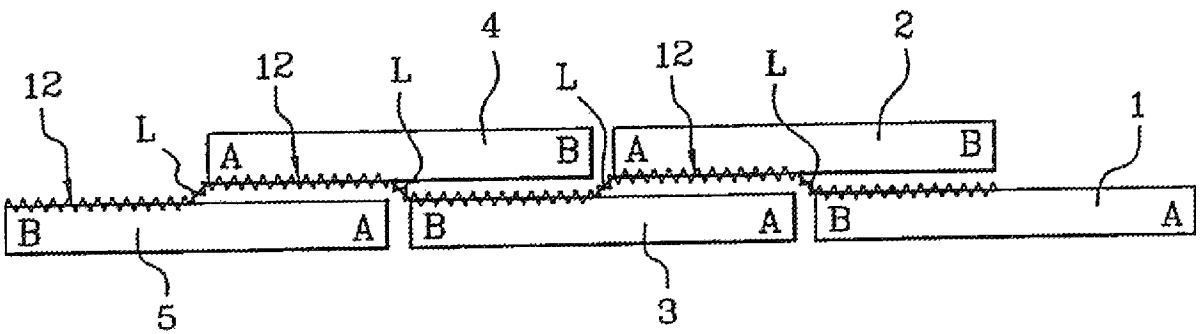

FIG. 1 depicts the storage position of the structure and FIG. 2 the position deployed on the ground with the letters A and B denoting the respective ends of each plate in each of the positions.

The plates 1 to 6 are connected by a flexible band B fixed successively to a half-face of each plate and preferably over its entire length.

Between two consecutive plates, the band 12 defines an articulated connecting area L forming a hinge and connecting the edge of one plate to the central part of the following plate.

Figure 3:
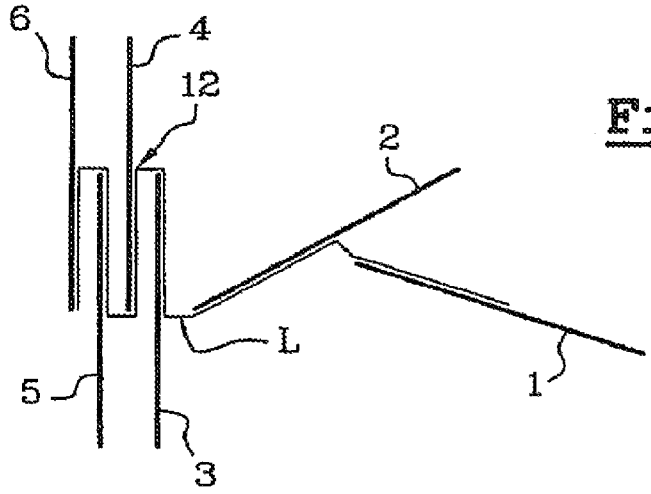
FIGS. 3-5 illustrate the deployment of the plates 1-6 of FIG. 1 in order to arrive at the double-dashed covering layer of FIG. 2.
Figure 4:
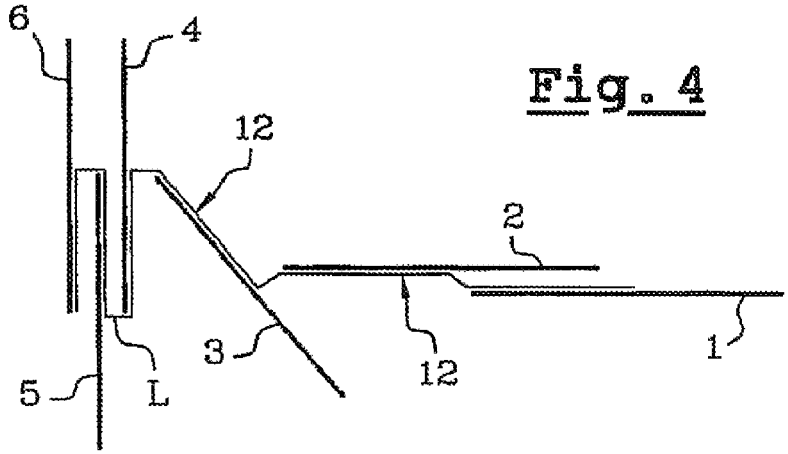
Figure 5:
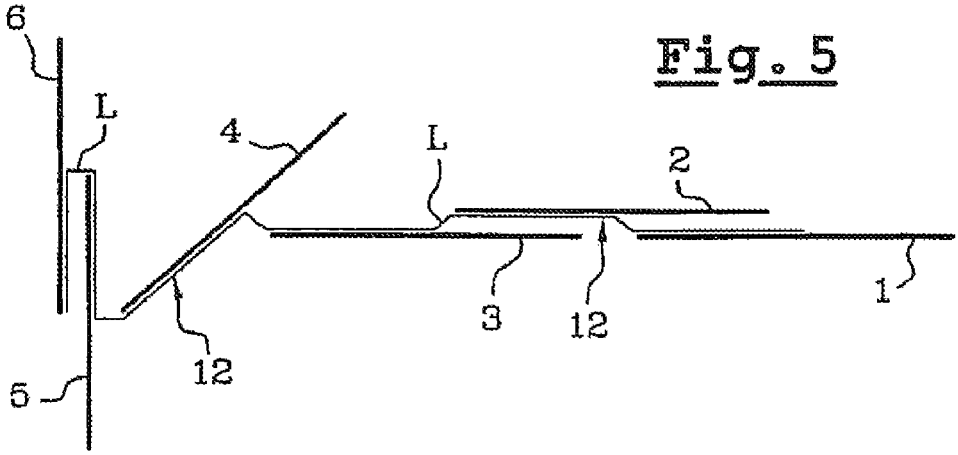

FIGS. 3 to 5 illustrate the deployment of the plates 1 to 6 of FIG. 1 in order to arrive at the double-covering layer of FIG. 2, where the plates are superimposed in a staggered manner and are all aligned in the same direction, which is parallel for example to the transverse axis of the band 12 completely deployed and sandwiched between the two layers of plates, moreover practically contiguous.

Figure 6:
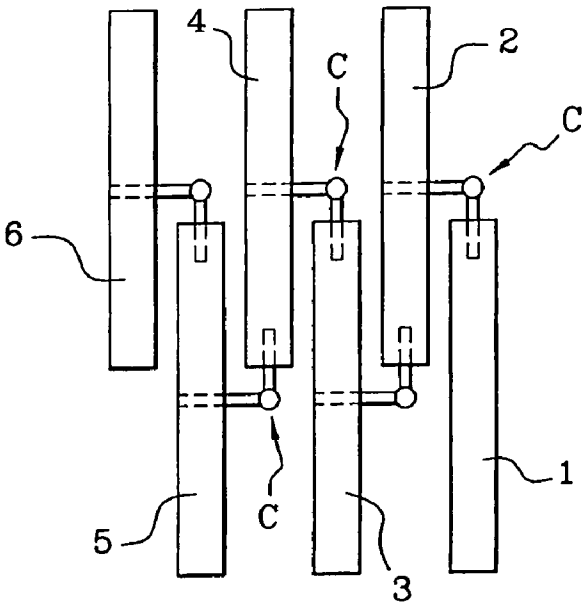
FIGS. 6 and 7 schematically illustrate a second embodiment.
Figure 7:
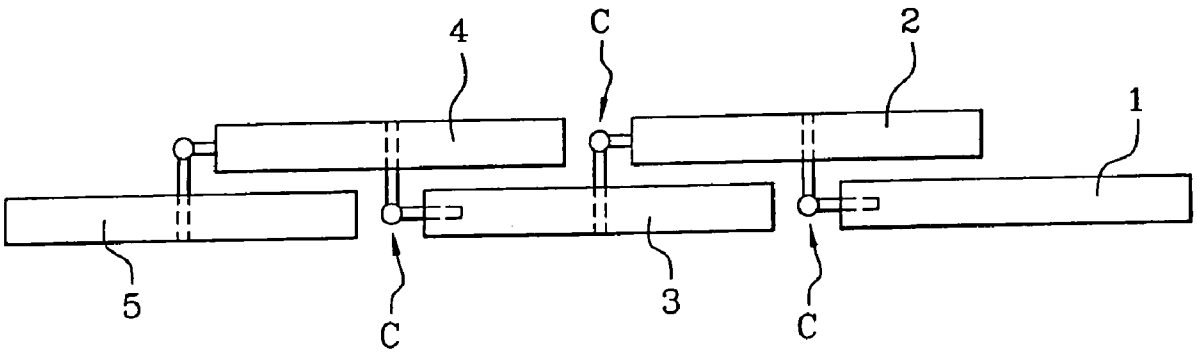

FIGS. 6 and 7 illustrate another variant in which the articulated connecting element is a hinge C, one element of which is fixed to the edge of a plate 1 and the other element of which is fixed to the associated plate 2, in its central part.

The hinge C is a single one and extends over the entire width (or length) of the plate 2 or is formed from several individual aligned elements.

Figure 8:
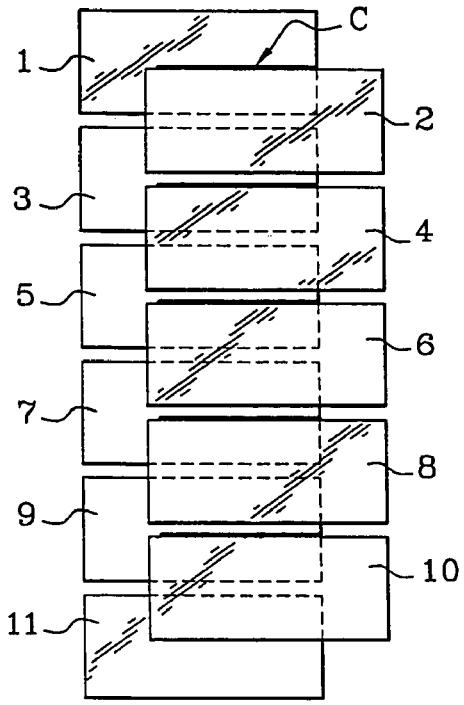
FIGS. 8 and 9 schematically illustrate a third embodiment.

FIG. 8 illustrates a variant in which the plates of the bottom layer (the odd plates) 1, 3, 5, 7, 9, 11 are offset longitudinally with respect to the (even) plates 2, 4, 6, 8, 10 of the top layer. In this ease, the connecting elements, for example, of the hinges C do not extend over the entire length of the plates but only opposite the overlapping areas.

Figure 9:
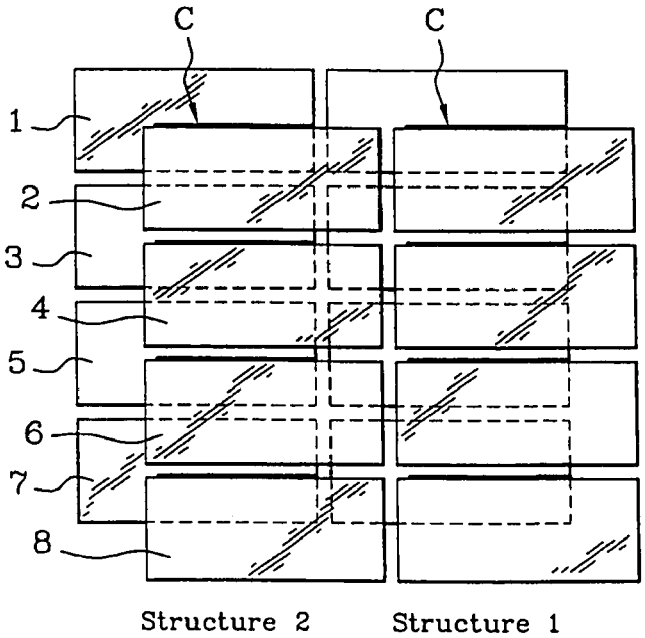

This makes it possible (FIG. 9) to position two covering structures side by side and contiguous whilst having a partial overlapping of one structure (N° 1) by the other structure (N° 2). Thus there does not exist, between the structures 1 and 2, any area of lesser strength because of the offset of the top layer of the plates with respect to the bottom, in the two axes respectively of the plates. directions defined by the longitudinal and transverse A reversible mechanical locking can be provided between the two structures 1 and 2, for example between the bottom plates of one structure and the top plates of the second structure, in order to guarantee good positioning of the structures and perfect connection between them.

The invention claimed is:

1. A temporary dual-layer rapid-deployment ground-covering structure formed from a plurality of plates made from suitable material, wherein said plurality of plates are disposed parallel to each other and connected to each other in cascade by an articulated connecting element so that, between two consecutive plates, said connecting element is connected firstly to an edge of only one of said two consecutive plates and secondly to a central area of another one of said plates, each said connecting element defining inter-plate articulation axes parallel to a longitudinal or transverse axis of the plurality of plates, and wherein said articulated connecting element is a single continuous flexible band that connects to all of said plural plates.

2. The structure as claimed in claim 1, wherein said plurality of plates are rigid.

3. A temporary dual-layer rapid-deployment ground-covering structure, comprising:

plural identical rectangular plates having opposing first and second ends; and an articulated connecting element connecting two adjacent ones of said plural plates, said plural plates being movable from a first position wherein each of said plural plates is stacked one on another to a second position wherein first ones of said plural plates are coplanar and remaining ones of said plural plates are parallel to said first ones of said plural plates and coplanar with each other, said plural plates being in a dual layer configuration that is placed on the ground in said second position with a respective first end of one of said first ones of said plural plates overlying a corresponding second end of one of said remaining ones of said plural plates, wherein said articulated connecting element is a single continuous flexible band that connects to all of said plural plates.

4. A temporary dual-layer rapid-deployment ground-covering structure, comprising:

plural identical rectangular plates having opposing first and second ends; and an articulated connecting element connecting two adjacent ones of said plural plates, said plural plates being movable from a first position wherein each of said plural plates is stacked one on another to a second position wherein first ones of said plural plates are coplanar and remaining ones of said plural plates are parallel to said first ones of said plural plates and coplanar with each other, said plural plates being in a dual layer configuration that is placed on the ground in said second position with a respective first end of one of said first ones of said plural plates overlying a corresponding second end of one of said remaining ones of said plural plates, wherein the plural plates are connected to each other in cascade by a respective said articulated connecting element so that, between two consecutive plates, said connecting element is connected to said one edge of one of said plural plates and connected to a center of a second one of said plural plates.

5. The structure as claimed in claim 4, wherein said articulated connecting element is a single continuous flexible band that connects to all of said plural plates.

6. The structure as claimed in claim 4, wherein said articulated connecting element includes plural hinges that connect two respective adjacent ones of said plural plates.

7. A temporary dual-layer rapid-deployment ground-covering structure, comprising:

at least five identical plates each having first and second opposing ends; and a connecting element connecting two adjacent ones of said plates, said plates forming a dual-layer structure by first, third and fifth ones of said plates being coplanar, first ends of second and fourth ones of said plates overlying second ends of said first, third and fifth ones of said plates and being coplanar with each other, wherein the plates are connected to each other in cascade by a respective said connecting element so that, between two consecutive plates, said connecting element is connected to one edge of one of said plates and connected to a center of a second one of said plates, and wherein said articulated connecting element is a single continuous flexible band that connects to all of said plural plates.

8. The structure as claimed in claim 7, wherein said articulated connecting element includes plural hinges that connect two respective adjacent ones of said plural plates.

* * * * *